US006257034B1

(12) United States Patent
Fukumori et al.

(10) Patent No.: US 6,257,034 B1
(45) Date of Patent: Jul. 10, 2001

(54) SYSTEM AND METHOD FOR PREVENTING SCALE DEFECTS DURING HOT ROLLING

(75) Inventors: Junso Fukumori; Tsutomu Kawamizu; Akira Kaya, all of Hiroshima; Jong Won Lee, Tokyo, all of (JP); Kyung Zoon Min; Woon Yong Choi, both of Kyungbuk (KR)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/501,789

(22) Filed: Feb. 11, 2000

(30) Foreign Application Priority Data

Feb. 24, 1999 (JP) ..... 11-045778

(51) Int. Cl.[7] ..... B21B 45/04; B21B 27/06
(52) U.S. Cl. ..... 72/39; 72/201
(58) Field of Search ..... 72/201, 39, 40, 72/200, 202

(56) References Cited

U.S. PATENT DOCUMENTS 5,235,840 * 8/1993 Blazevic ..... 72/201

FOREIGN PATENT DOCUMENTS 7-171610 7/1995 (JP) .

* cited by examiner

*Primary Examiner*—Rodney A. Butler

(57) ABSTRACT

A system and a method are disclosed for preventing scale defects during hot rolling by hot rolling equipment having a scale breaker provided at an entry side of a finishing mill line composed of a plurality of rolling mills arranged in tandem. A descaler is provided between a first stage rolling mill and a second stage rolling mill of the finishing mill line. A cooler for cooling a hot rolled steel plate is provided between the second stage rolling mill and a third stage rolling mill of the finishing mill line. A control device is provided for controlling the descaler and the cooler to be selectively driven such that neither of the descaler and the cooler is actuated, one of the descaler and the cooler is actuated, or both of the descaler and the cooler are actuated, according to rolling conditions. Thus, the hot rolled steel plate is rolled, with its oxide film thickness at an entry side of the third stage rolling mill being restricted to not more than a limiting oxide film thickness of 5 $\mu$m. Consequently, scale defects are prevented, and overcooling of the hot rolled steel plate is suppressed, to improve the quality of a product.

22 Claims, 9 Drawing Sheets

SYSTEM AND METHOD FOR PREVENTING SCALE DEFECTS DURING HOT ROLLING

BACKGROUND OF THE INVENTION

1. Field of the Invention

The present invention relates to a system and a method for preventing scale defects on a finish rolling line of hot rolling equipment by descaling or cooling a surface of a material to be rolled (hot rolled steel plate) to suppress the formation of scale (oxide film).

2. Description of the Related Art

In hot finish rolling, oxide film may grow after scale removal at an entry side of a row of finishing mills. Depending on the thickness of the oxide film, scale defects occur in a hot rolled steel plate to decrease the yield of the product and deteriorate its surface quality. To suppress the growth of oxide film, it has been performed empirically to set the temperature of the steel plate surface, or to control the temperature of the steel plate surface at the entry side of the row of finishing mills. When the growth of oxide film was suppressed by any of these conventional methods, the hot rolled steel plate was overcooled, or occurrence of scale defects was not fully prevented.

FIG. 8 is a view showing another conventional method for preventing scale defects. In this drawing, a hot rolled steel plate 1, as a material to be rolled, passes, while being rolled, between a first stage rolling mill F1 and a seventh stage rolling mill F7 from an entry side to a delivery side (from left to right in the drawing). At a stage forward of the first stage rolling mill F1, a scale breaker FSB is placed for removing oxide film of the hot rolled steel plate 1 rough rolled by a roughing mill (not shown). High pressure water from a header 2 of the scale breaker FSB removes oxide film on the surface of the hot rolled steel plate 1. At an entry side of each of the second stage rolling mill F2 and the third stage rolling mill F3, descaling devices 12, 13 are placed. These descaling devices 12, 13 jet spray water when the thickness of oxide film on the surface of the steel plate is more than 10 $\mu$m. After being so descaled, the steel plate is rolled.

However, when the descaling devices are arranged between the rolling mills as in FIG. 8 to perform descaling for oxide film more than 10 $\mu$m thick, the thickness of oxide film at the entry side of the third stage rolling mill F3 may exceed 5 $\mu$m as shown in FIG. 9. Finish rolling performed at an oxide film thickness of more than 5 $\mu$m results in the occurrence of scale defects on the surface of the hot rolled steel plate 1, debasing the quality of the product. A thermometer 11 is provided at the entry side of the row of finishing mills so that the thickness of oxide film is predicted from the temperature of the steel plate detected, as well as the speed of the steel plate. Actually, the distance from the position of temperature detection to the descaling devices is so short that descaling control tends to be performed with some delay.

SUMMARY OF THE INVENTION

The pre sent invention controls an operating state of a descaler or a cooler placed between finishing mills. By so doing, the invention aims to restrict the thickness of oxide film, which occurs on a material to be rolled, to not more than a limiting oxide film thickness, thereby preventing the occurrence of scale defects of the material to be rolled. The invention also intends to suppress overcooling of the material to be rolled. Through these measures, the invention is to improve the quality of the product.

According to a first aspect of the present invention designed to attain the above-described objects, there is provided a system for preventing scale defects during hot rolling by hot rolling equipment having a scale breaker provided at an entry side of a finishing mill line composed of a plurality of rolling mills arranged in tandem, comprising:

a descaler provided between a first stage rolling mill and a second stage rolling mill of the finishing mill line;

a cooler, provided between the second stage rolling mill and a third stage rolling mill of the finishing mill line, for cooling a material to be rolled; and a control device for controlling the descaler and the cooler to be selectively driven such that neither of the descaler and the cooler is actuated, one of the descaler and the cooler is actuated, or both of the descaler and the cooler are actuated, according to rolling conditions, whereby the material to be rolled is rolled, with an oxide film thickness of the material at an entry side of the third stage rolling mill being restricted to not more than a limiting oxide film thickness.

Since rolling is performed, with the thickness of oxide film at the entry side of the third stage rolling mill being restricted to the limiting oxide film thickness or less, scale defects of the material to be rolled can be prevented, and a drop in the plate temperature of the material to be rolled can be minimized. Furthermore, the absence of scale defects can lead to an improved quality and an increased yield of a rolled product.

According to a second aspect of the present invention, there is provided a system for preventing scale defects during hot rolling by hot rolling equipment having a scale breaker provided at an entry side of a finishing mill line composed of a plurality of rolling mills arranged in tandem, comprising:

a descaler provided between a first stage rolling mill and a second stage rolling mill of the finishing mill line;

a descaler provided between the second stage rolling mill and a third stage rolling mill of the finishing mill line; and a control device for controlling the descalers to be selectively driven such that neither of the descalers is actuated, one of the descalers is actuated, or both of the descalers are actuated, according to rolling conditions, whereby a material to be rolled is rolled, with an oxide film thickness of the material at an entry side of the third stage rolling mill being restricted to not more than a limiting oxide film thickness.

According to this aspect of the invention, the same effects as those obtained by the first aspect of the invention are obtained.

In the above aspects, the limiting oxide film thickness may be 5 $\mu$m. Thus, scale defects of the material to be rolled can be prevented reliably. Moreover, water at a low pressure of at least about 70 kgf/cm$^2$ may be jetted by the descaler. Thus, economic descaling can be performed.

Besides, the control device may function as follows:

The control device computes the oxide film thickness of the material at the entry side of the third stage rolling mill based on a temperature of the material at a delivery side of a roughing mill, and if the computed oxide film thickness is not more than the limiting oxide film thickness, the control device actuates neither of the descaler and the cooler;

if the computed oxide film thickness is more than the limiting oxide film thickness, the control device incorporates the descaler into operating conditions and computes the oxide film thickness, and if the computed oxide film thickness is not more than the limiting oxide film thickness, the control device actuates only the descaler;

if the oxide film thickness computed after incorporating the descaler into the operating conditions is more than the limiting oxide film thickness, the control device incorporates both the descaler and the cooler into the operating conditions and computes the oxide film thickness, and if the computed oxide film thickness is not more than the limiting oxide film thickness, the control device actuates both the descaler and the cooler; and if the oxide film thickness computed after incorporating both the descaler and the cooler into the operating conditions is more than the limiting oxide film thickness, the control device actuates both the descaler and the cooler while increasing the ability of both the descaler and the cooler.

Thus, the descaler and the cooler are controlled to be efficiently operative according to rolling conditions, so that scale defects in the material to be rolled can be prevented reliably.

Alternatively, the control device may have the following functions: The control device computes the oxide film thickness of the material at the entry side of the third stage rolling mill based on a temperature of the material at a delivery side of a roughing mill, and if the computed oxide film thickness is not more than the limiting oxide film thickness, the control device actuates neither of the descaler at the preceding stage and the descaler at the succeeding stage;

if the computed oxide film thickness is more than the limiting oxide film thickness, the control device incorporates the descaler at the preceding stage into operating conditions and computes the oxide film thickness, and if the computed oxide film thickness is not more than the limiting oxide film thickness, the control device actuates only the descaler at the preceding stage;

if the oxide film thickness computed after incorporating the descaler at the preceding stage into the operating conditions is more than the limiting oxide film thickness, the control device incorporates both the descaler at the preceding stage and the descaler at the succeeding stage into the operating conditions and computes the oxide film thickness, and if the computed oxide film thickness is not more than the limiting oxide film thickness, the control device actuates both the descaler at the preceding stage and the descaler at the succeeding stage; and if the oxide film thickness computed after incorporating both the descaler at the preceding stage and the descaler at the succeeding stage into the operating conditions is more than the limiting oxide film thickness, the control device actuates both the descaler at the preceding stage and the descaler at the succeeding stage while increasing the ability of both the descaler at the preceding stage and the descaler at the succeeding stage.

Thus, the descalers at the preceding stage and the succeeding stage are controlled to be operative efficiently according to rolling conditions, so that scale defects in the material to be rolled can be prevented reliably.

According to a third aspect of the present invention, there is provided a method for preventing scale defects during hot rolling by hot rolling equipment having a scale breaker provided at an entry side of a finishing mill line composed of a plurality of rolling mills arranged in tandem, comprising:

providing a descaler between a first stage rolling mill and a second stage rolling mill of the finishing mill line;

providing a cooler between the second stage rolling mill and a third stage rolling mill of the finishing mill line for cooling a material to be rolled; and controlling the descaler and the cooler to be selectively driven such that neither of the descaler and the cooler is actuated, one of the descaler and the cooler is actuated, or both of the descaler and the cooler are actuated, according to rolling conditions, thereby rolling the material to be rolled, while restricting an oxide film thickness of the material at an entry side of the third stage rolling mill to not more than a limiting oxide film thickness.

Thus, the same effects as the effects of the first aspect of the invention are obtained.

According to a fourth aspect of the present invention, there is provided a method for preventing scale defects during hot rolling by hot rolling equipment having a scale breaker provided at an entry side of a finishing mill line composed of a plurality of rolling mills arranged in tandem, comprising:

providing a descaler between a first stage rolling mill and a second stage rolling mill of the finishing mill line;

providing a descaler between the second stage rolling mill and a third stage rolling mill of the finishing mill line; and controlling the descalers to be selectively driven such that neither of the descalers is actuated, one of the descalers is actuated, or both of the descalers are actuated, according to rolling conditions, thereby rolling a material to be rolled, while restricting an oxide film thickness of the material at an entry side of the third stage rolling mill to not more than a limiting oxide film thickness.

Thus, the same effects as the effects of the first aspect of the invention are obtained.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Embodiments of a system and a method for preventing scale defects during hot rolling according to the present invention will now be described in detail by reference to the accompanying drawings.

Figure 8:
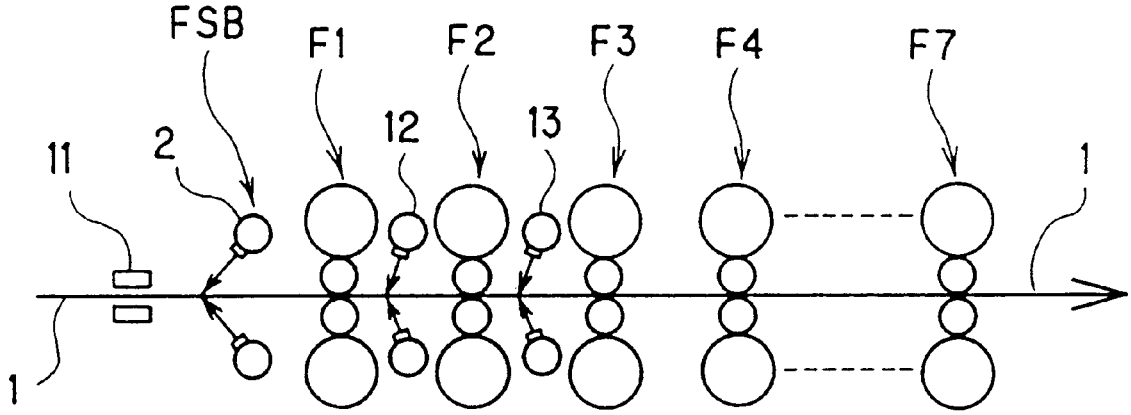
Fig.8 Prior Art
FIG. 8 is an explanation drawing of a conventional system for preventing scale defects during hot rolling.

A first embodiment of the present invention is described with reference to FIGS. 1 to 5. The same members as those in FIG. 8 explained in connection with the earlier technology are assigned the same reference numerals, and overlapping explanations are omitted.

According to this embodiment, a descaler (scale removing device) D is placed between a first stage rolling mill F1 and a second stage rolling mill F2, and a cooler C is placed between the second stage rolling mill F2 and a third stage rolling mill F3. The descaler and the cooler C are controlled to be capable of restricting the thickness of oxide film (scale thickness) to fall within allowable values.

Figure 5:
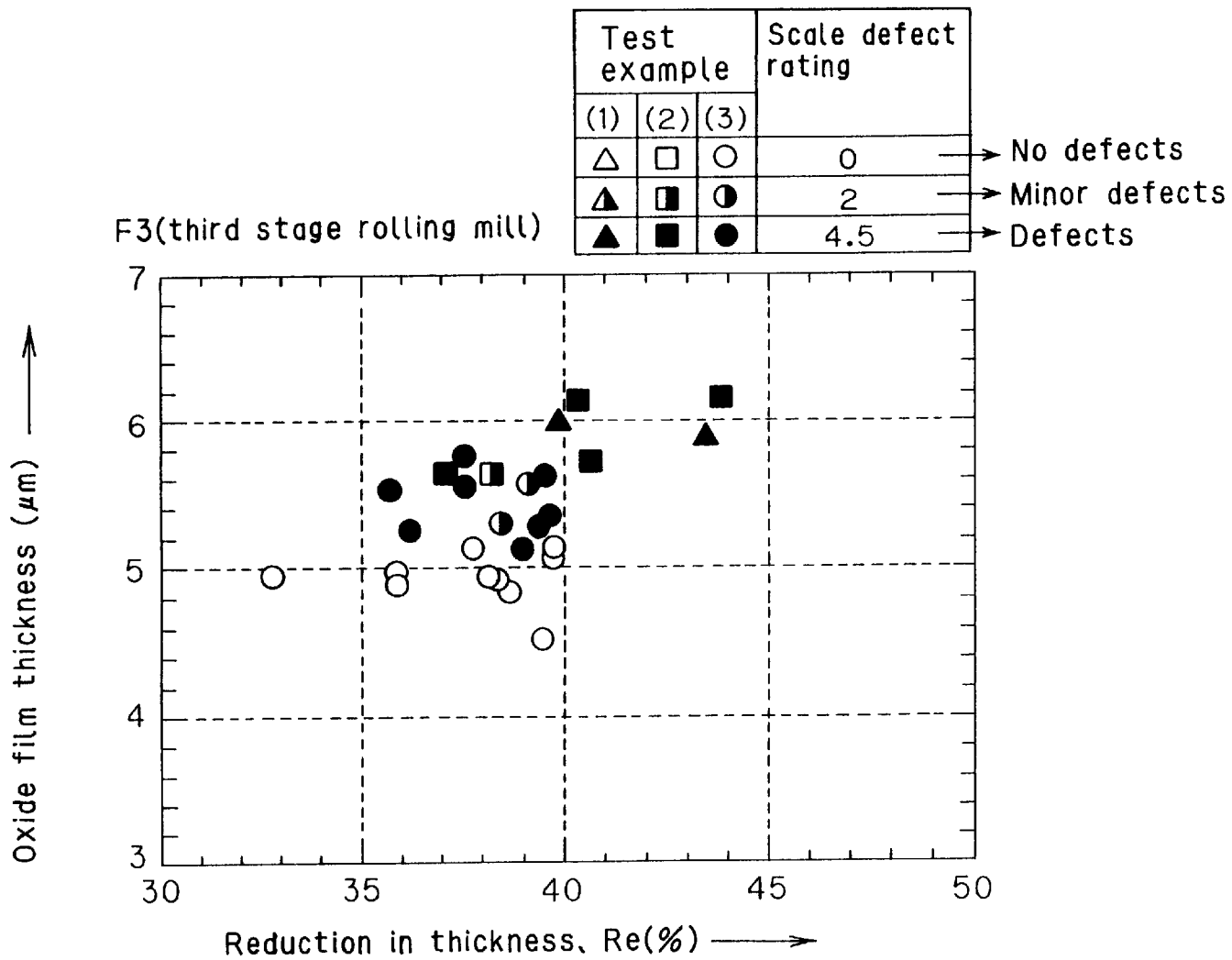
FIG. 5 is a view showing the relation between the oxide film thickness and scale defect ratings in a third stage rolling mill F3 according to the first embodiment.

First of all, the relation between the oxide film thickness and scale defects is described with reference to FIG. 5. FIG. 5 shows test values with the third stage rolling mill F3. Δ, □, and ○ represent the appearances of the surface of a steel plate in each of Test Examples (1), (2) and (3), which are expressed as scale defect ratings. Regardless of the magnitude of a reduction in thickness, Re (%), when the thickness of oxide film is more than 5 μm, the scale defect rating is 2 or 4.5, meaning "Minor defects" or "Defects", respectively. When the oxide film thickness is 5 μm or less, the scale defect rating is 0, meaning "No defects". In view of these findings, when the thickness of oxide film is more than 5 μm at the third stage rolling mill F3, scale defects occur. When the thickness of oxide film is restricted to 5 μm or less, a hot rolled steel plate free from scale defects is obtained.

Based on the above test results in combination with actual machine tests and laboratory tests, the present invention has set a limiting oxide film thickness, at more than which scale defects occur during hot rolling, to be about 5 μm at an entry side of the third stage rolling mill F3, and performs descaling and water cooling of a hot rolled steel plate while maintaining the set thickness.

Figure 1:
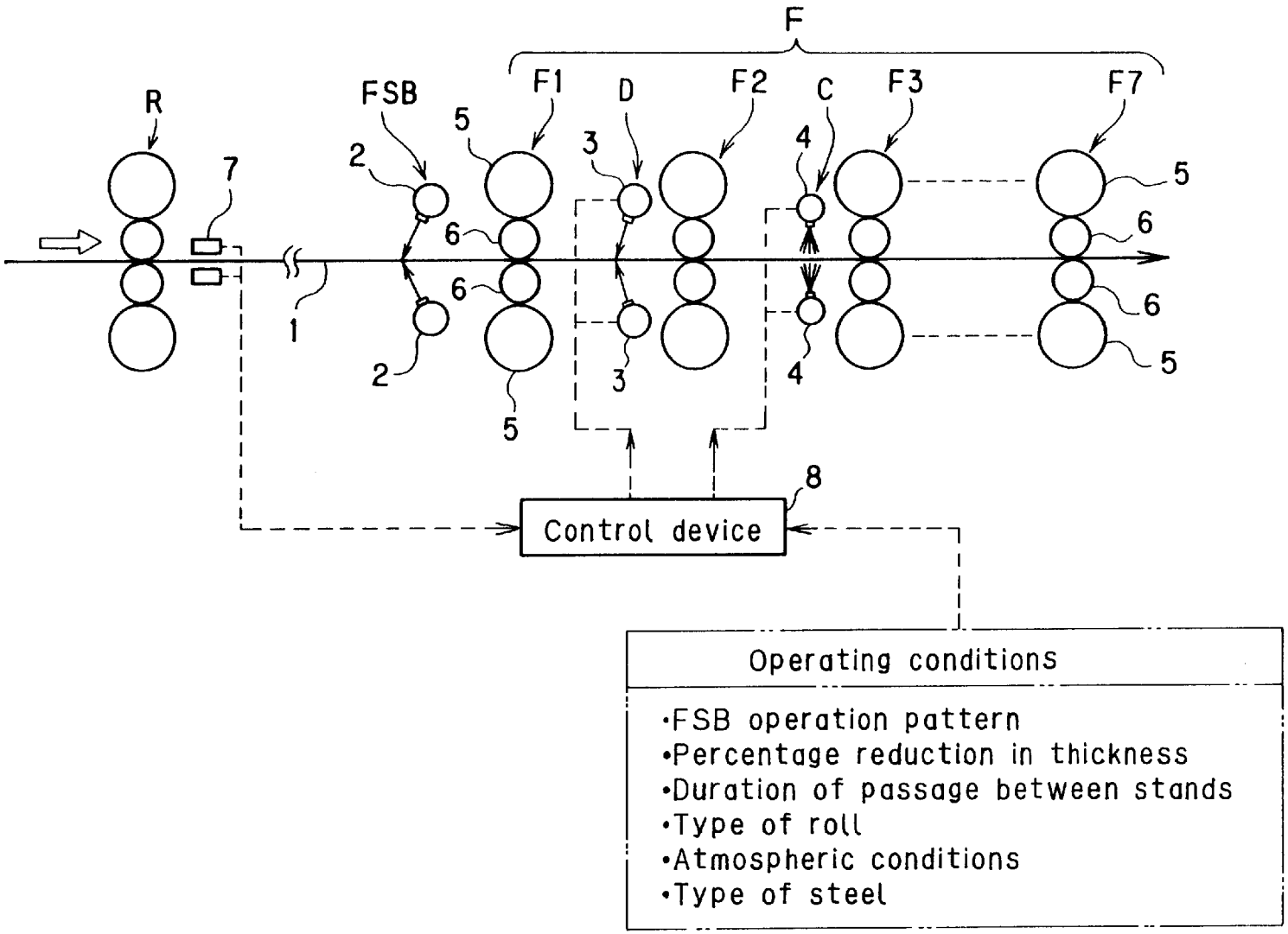
FIG. 1 is an explanation drawing of a system for preventing scale defects in a hot rolled steel plate, showing a first embodiment of the present invention.

In FIG. 1, a hot rolled steel plate (strip plate) 1, as a material to be rolled, passes, while being rolled, between the respective rolling mills of a finishing mill line F comprising the first stage rolling mill F1 to a seventh stage rolling mill F7, from an entry side to a delivery side (from left to right in the drawing). In each of the rolling mills F1 to F7, a pair of work rolls 6, 6 and a pair of backup rolls 5, 5 are arranged at upper and lower positions, with the hot rolled steel plate 1 being sandwiched between the work rolls 6 and 6. Between the first stage rolling mill F1 and the second stage rolling mill F2, a descaler (scale removing device) D is placed. The descaler D comprises headers 3, 3 for a jet medium arranged at upper and lower positions, with the hot rolled steel plate 1 being sandwiched between the headers 3 and 3. From a nozzle at the tip of the header 3, a jet medium can be jetted toward the hot rolled steel plate 1.

Between the second stage rolling mill F2 and the third stage rolling mill F3, a cooler C for a steel plate surface is disposed, which comprises headers 4, 4 for cooling water arranged at upper and lower positions, with the hot rolled steel plate 1 being sandwiched between the headers 4 and 4. From a nozzle at the tip of the header 4, cooling water can be jetted toward the hot rolled steel plate 1.

At an entry side of the first stage rolling mill F1, a scale breaker FSB is placed for removing scale of the hot rolled steel plate 1 that has been rough rolled. The scale breaker FSB comprises headers 2, 2 disposed at upper and lower positions, with the hot rolled steel plate 1 being sandwiched between the headers 2 and 2. From a nozzle at the tip of the header 2, high pressure water is jetted toward the hot rolled steel plate 1 to remove scale on the surface of the hot rolled steel plate 1. A radiation thermometer 7 is disposed near a delivery side of a roughing mill R which is placed on the hot rolling line at a location several tens of meters to several hundreds of meters upstream from the first stage rolling mill F1.

A control device 8 receives, whenever necessary, information on the operating conditions and the temperature of the steel plate surface at the delivery side of the roughing mill R, and computes the thickness of oxide film by simulation. Control signals based on the results of computation are fed to the cooler C and the descaler D.

With the use of the descaler D and the cooler C disposed as described above, descaling and cooling of the hot rolled steel plate are performed so that the scale thickness can be restricted to fall within the allowable range.

To suppress the occurrence of oxide film by the foregoing hot rolling equipment for preventing scale defects, the following steps are taken: The hot rolled steel plate 1 rough rolled by the roughing mill R is fed from left to right in the drawing. High pressure water at a jet pressure of, say, 150 $kgf/cm^2$is jetted from the nozzle at the tip of the header 2 of the scale breaker FSB toward the hot rolled steel plate 1 to remove scale on the surface of the hot rolled steel plate 1. Furthermore, the descaler D and the cooler C are actuated, where necessary, so as to restrict the oxide film thickness at the entry side of the third stage rolling mill F3 to the allowable value or less. During this process, the hot rolled steel plate 1 is rolled by the first stage rolling mill F1 to the seventh stage rolling mill F7 to prevent its scale defects.

Figure 4:
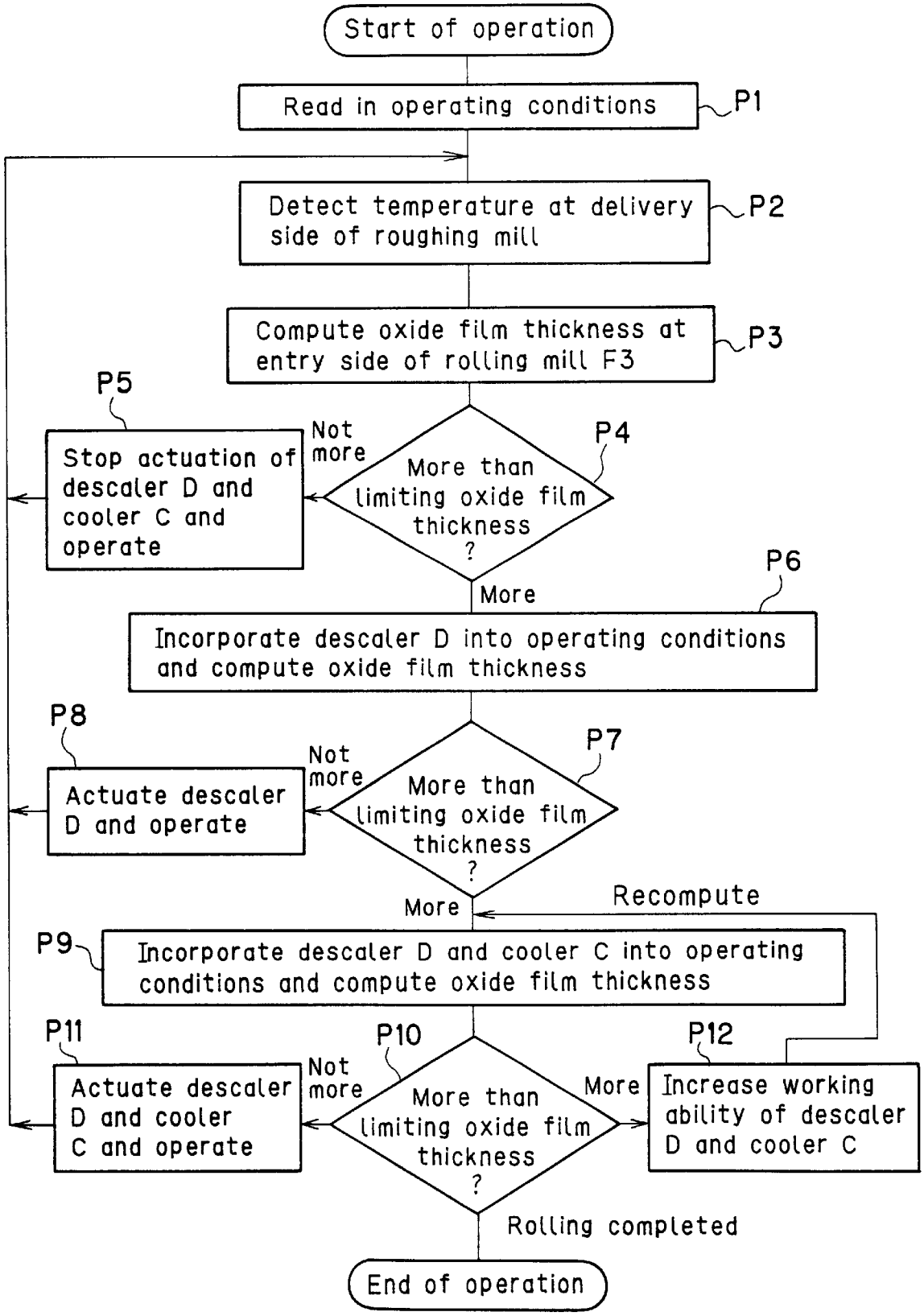
FIG. 4 is a control flow chart for a descaler and a cooler in the first embodiment.

The actuating state of the descaler D and the cooler C will be described with reference to FIG. 4. At Step 1, the operating conditions [FSB operation pattern (width of high pressure water jet, heat transfer coefficient, etc.), percentage reduction in thickness, duration of passage of the hot rolled steel plate 1 between stands, type of roll (coefficient of friction between hot rolled steel plate and roll, etc.), atmospheric conditions (temperature, emissivity of hot rolled steel plate, etc.), type of steel] are read into the control device 8. Then, at Step 2, the surface temperature of the hot rolled steel plate 1 near the delivery side of the roughing mill R is taken into the control device 8 by means of the radiation temperature 7. Based on these data entered, the oxide film thickness at the entry side of the third stage rolling mill F3 when the descaler D and the cooler C are inactive is computed at Step 3.

Then, at Step 4, if the computed oxide film thickness is less than or equal to the limiting film thickness, operation is continued, without actuating the descaler D and the cooler C, at step P5. If the computed oxide film thickness is greater than the limiting film thickness at Step 4, conditions including the actuation of the descaler D are incorporated into the aforementioned operating conditions, and the oxide film thickness at the entry side of the third stage rolling mill F3 is computed again (i.e., re-computed).

Then, at Step 7, if the re-computed oxide film thickness is less than or equal to the limiting film thickness, operation is continued, with the descaler D being actuated, at step P8. If the re-computed oxide film thickness is greater than the limiting film thickness at Step 7, conditions including the actuation of the descaler D and the cooler C are incorporated into the aforementioned operating conditions, and the oxide film thickness at the entry side of the third stage rolling mill F3 is re-computed once again.

Then, at Step 10, if the twice re-computed oxide film thickness is less than or equal to the limiting film thickness, operation is continued, with the descaler D and the cooler C being actuated, at step P11. If the twice re-computed oxide film thickness is greater than the limiting film thickness at Step 10, a judgment is made, at Step 12, that the current operation surpasses a normal operational state. Thus, the working ability of the descaler D and the cooler C is increased, and the recomputation at Step 9 is repeated to restrict the film thickness to the limiting film thickness or less. In this state, the descaler D and the cooler C are actuated, and operation is performed.

The descaler D actuated in this manner allows the nozzle at the tip of the header 3 thereof to jet low pressure water at a jet pressure of, say, 70 kgf/cm$^2$ toward the hot rolled steel plate 1. Thus, even if oxide film on the hot rolled steel plate 1 rolled by the first stage rolling mill F1 grows because of recuperation (temperature recovery), the thickness of oxide film on the surface of the hot rolled steel plate 1 can be decreased.

When the cooler C is actuated, cooling water in an amount determined in consideration of recuperation (temperature recovery) on the steel plate surface is jetted from the nozzle at the tip of the header 4 of the cooler C toward the hot rolled steel plate 1 rolled by the second stage rolling mill F2 and heading for the third stage rolling mill F3. Thus, growth of oxide film is suppressed to decrease its thickness to the allowable value or less.

Figure 2:
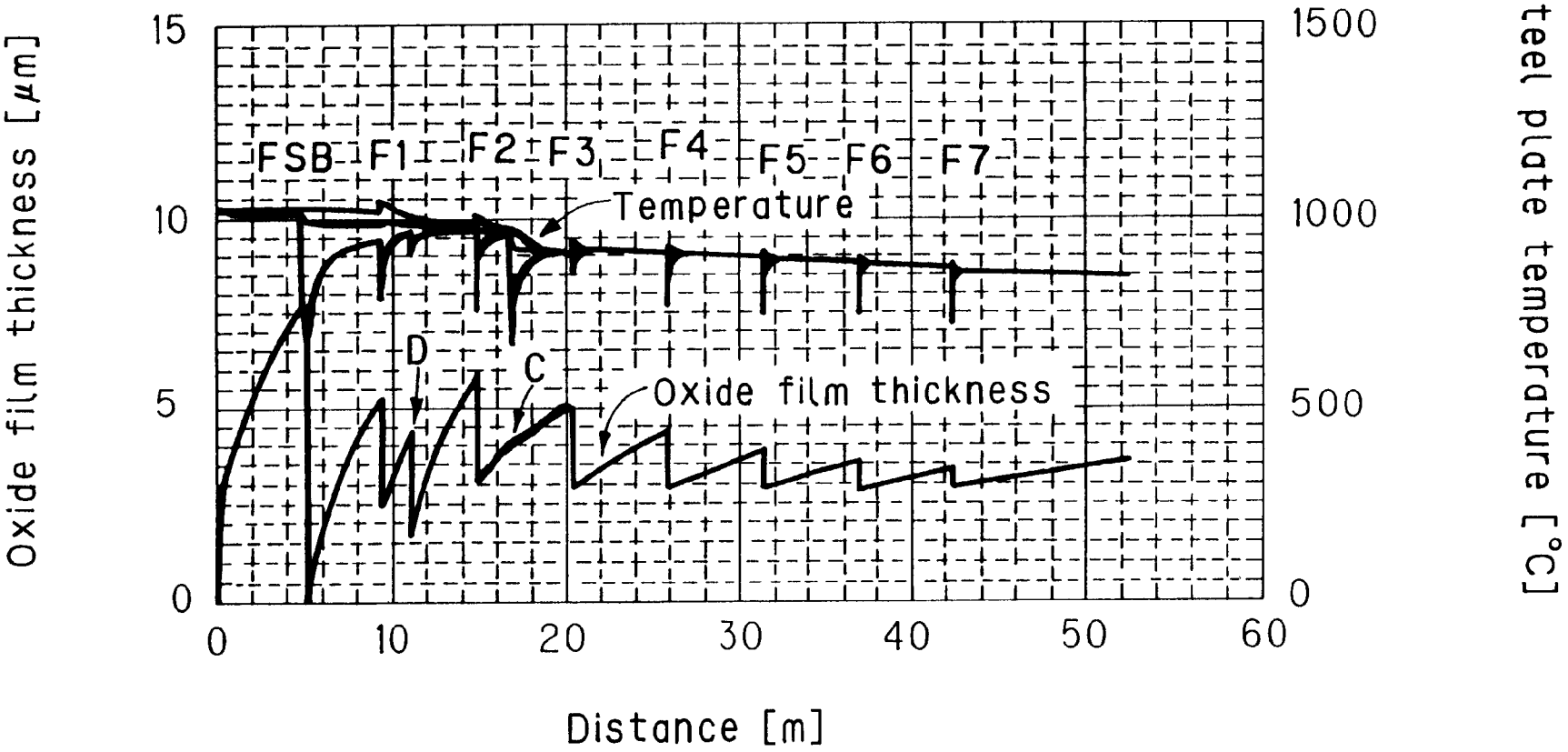
FIG. 2 is a diagram showing a steel plate temperature and an oxide film thickness in the first embodiment.
Figure 3:
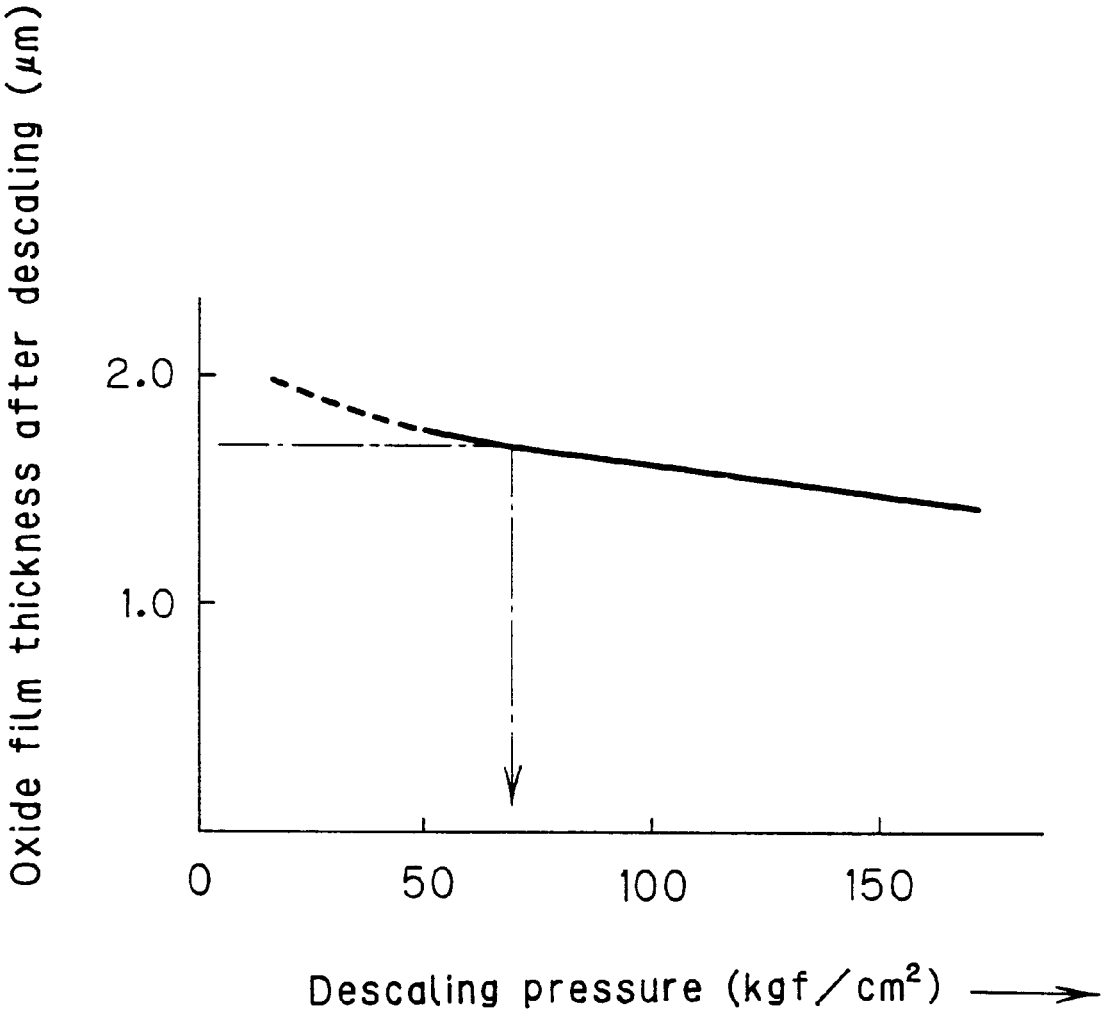
FIG. 3 is a graph showing a descaling pressure and the oxide film thickness in the first embodiment.

FIG. 2 shows an example of the relation between the steel plate temperature and the oxide film thickness during the above-described hot rolling. When the descaler D and the cooler C of the present invention are actuated, the oxide film thickness at the entry side of the third stage rolling mill F3 is shown to be restricted to about 5 $\mu$m. This diagram also shows that the oxide film thickness at the entry side of the rolling mill F3 is restricted to about 5 $\mu$m, when the oxide film thickness after actuation of the descaler D is about 1.7 $\mu$m. These findings demonstrate that the jet pressure (descaling pressure) of the descaler D for making the oxide film thickness 1.7 $\mu$m may be a low pressure of about 70 kgf/cm$^2$ as indicated in the graph of FIG. 3. Thus, economical descaling can be achieved by low pressure jetting.

Figure 9:
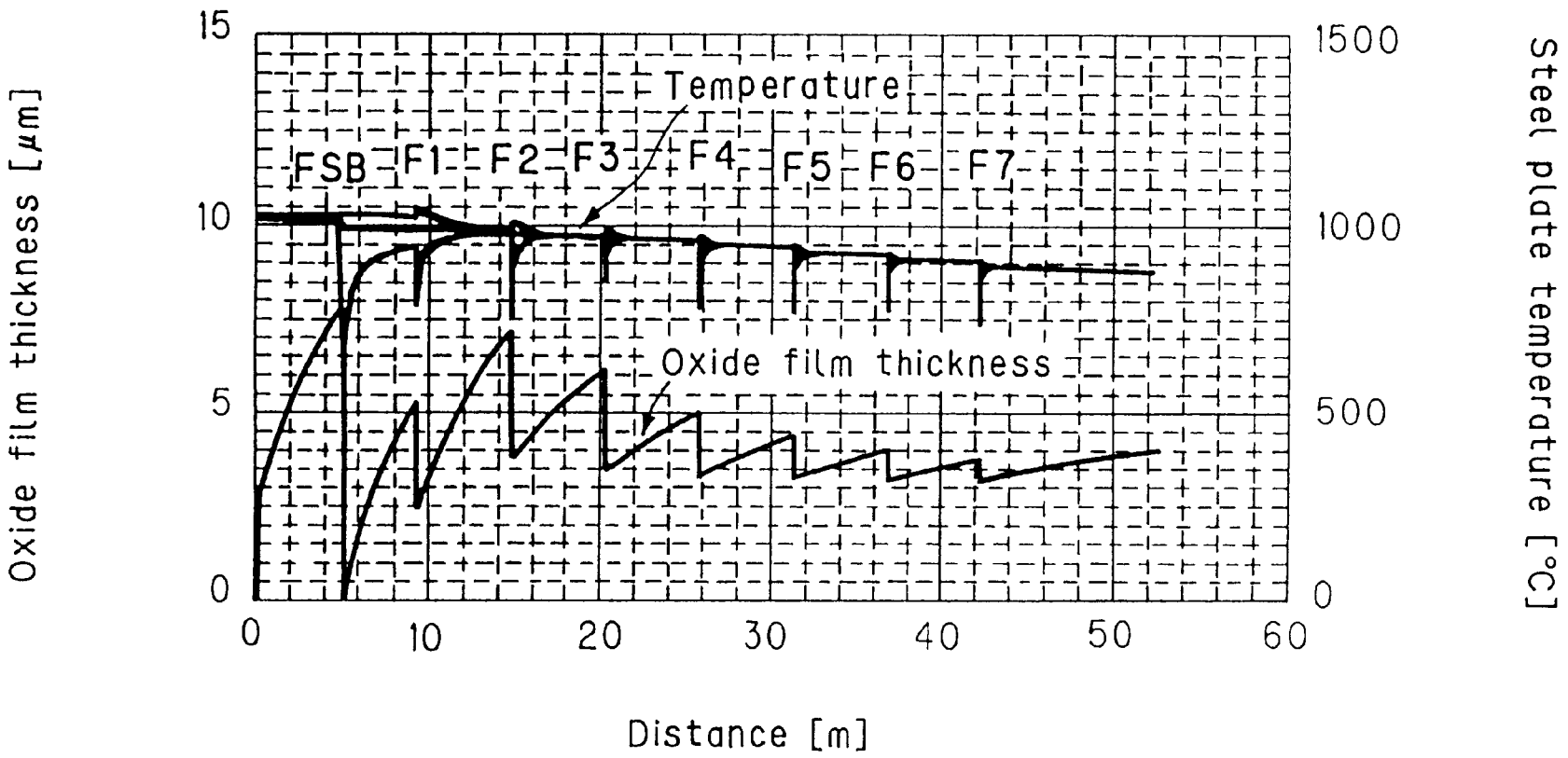
Prior Art Fig.9
FIG. 9 is a diagram showing a steel plate temperature and an oxide film thickness in the conventional system.

FIG. 9 shows an example of the relation between the steel plate temperature and the oxide film thickness when the cooler C is not actuated. The oxide film thickness at the entry side of the third stage rolling mill F3 is shown to exceed about 5 $\mu$m.

According to the present embodiment described above, the descaler D is provided between the first stage rolling mill F1 and the second stage rolling mill F2, and the cooler is provided between the second stage rolling mill F2 and the third stage rolling mill F3. The descaler D and the cooler C are actuated so that the oxide film thickness can be restricted to fall within the allowable range. In this state, rolling is carried out, with the oxide film thickness being restricted to the limiting oxide film thickness or less at the entry side of the third stage rolling mill F3. Consequently, scale defects of the hot rolled steel plate 1 can be prevented, and a drop in the plate temperature of the hot rolled steel plate 1 can be minimized. Since scale defects are absent, moreover, the quality of a hot rolled steel plate product can be improved, and its yield can be increased.

A second embodiment of the present invention is described with reference to FIG. 6. The same members as those in FIG. 1 explained in connection with the first embodiment are assigned the same reference numerals, and overlapping explanations are omitted.

According to this second embodiment, the cooler C placed between the second stage rolling mill F2 and the third stage rolling mill F3 in the first embodiment is abolished. Instead, another descaler (scale removing device) D2 is disposed, and the other constitutions are the same as in the First Embodiment.

Figure 6:
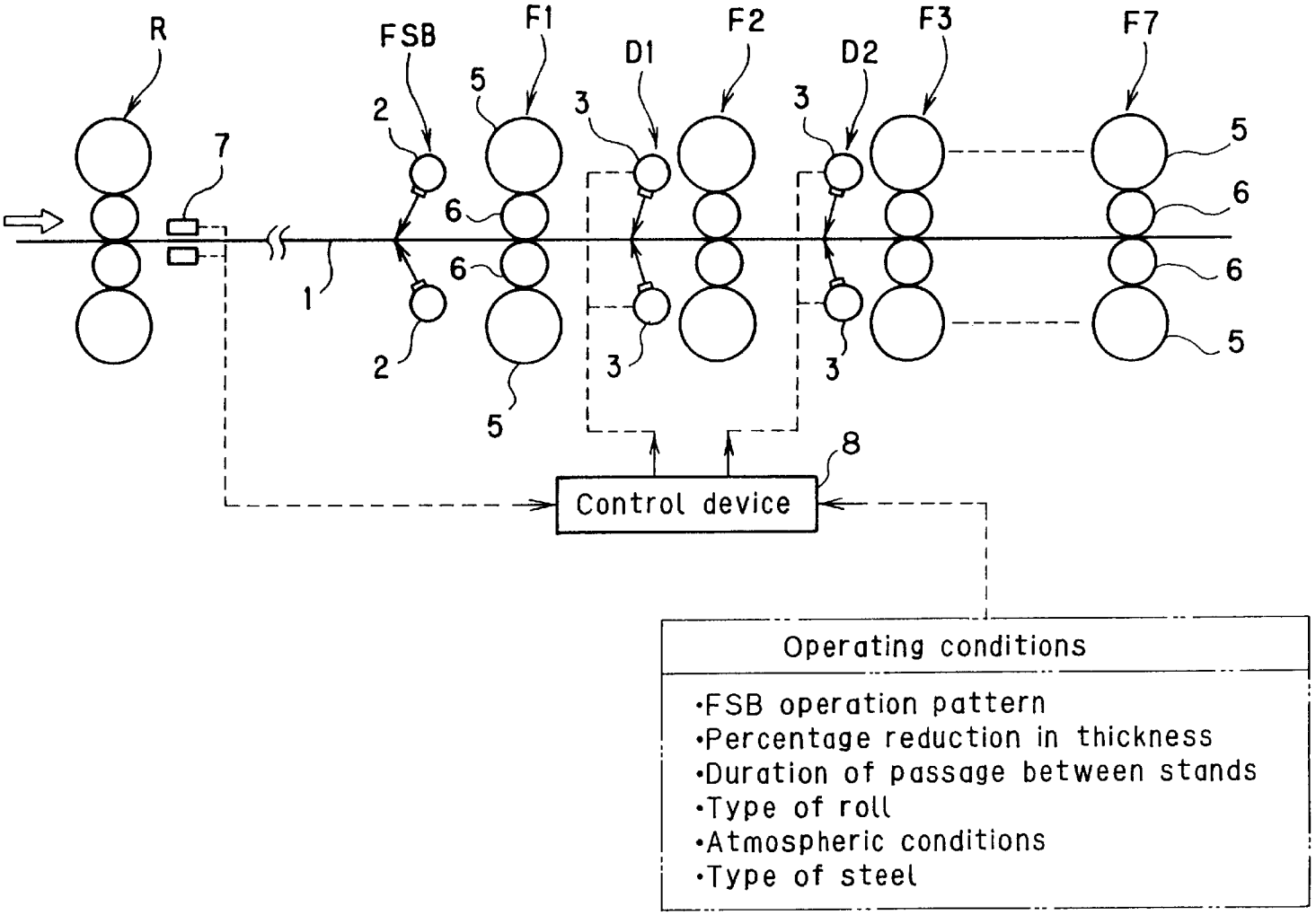
FIG. 6 is an explanation drawing of a system for preventing scale defects during hot rolling, showing a second embodiment of the present invention.

In FIG. 6, a descaler (scale removing device) D1 is placed between a first stage rolling mill F1 and a second stage rolling mill F2. The descaler D comprises headers 3, 3 for a jet medium disposed above and below a hot rolled steel plate 1, with the hot rolled steel plate 1 being sandwiched between the headers 3 and 3. From a nozzle at the tip of the header 3, a jet medium can be jetted toward the hot rolled steel plate 1.

Similarly, a descaler (scale removing device) D2 is placed between the second stage rolling mill F2 and the third stage rolling mill F3. The descaler D2 comprises headers 3, 3 for a jet medium disposed above and below the hot rolled steel plate 1, with the hot rolled steel plate 1 being sandwiched between the headers 3 and 3. From a nozzle at the tip of the header 3, a jet medium can be jetted toward the hot rolled steel plate 1.

The descaler D1 and the descaler D2 are arranged as described above, and the oxide film thickness at an entry side of the third stage rolling mill F3 is computed from the steel plate surface temperature from a radiation thermometer 7 and the operating conditions, as in the first embodiment. In descaling the hot rolled steel plate 1, the actuation of the descalers D1 and D2 is controlled such that this oxide film thickness can be restricted to the limiting oxide film thickness or less.

The other constitutions are nearly the same as in FIG. 1 for the first embodiment, and their explanations are omitted.

To suppress the occurrence of oxide film by the foregoing hot rolling equipment for preventing scale defects, the following steps are taken: The hot rolled steel plate 1 rough rolled by a roughing mill R is fed from left to right in the drawing. High pressure water at a jet pressure of, say, 150 kgf/cm$^2$ is jetted from a nozzle at the tip of a header 2 of a scale breaker FSB toward the hot rolled steel plate 1 to remove scale on the surface of the hot rolled steel plate 1. Furthermore, the descaler D1 and the descaler D2 are actuated, where necessary, so as to restrict the oxide film thickness at an entry side of the third stage rolling mill F3 to the limiting oxide film thickness or less. During this process, the hot rolled steel plate 1 is rolled by the first stage rolling mill F1 to a seventh stage rolling mill F7 to prevent its scale defects.

The actuation of the descaler D1 and the descaler D2 is performed in nearly the same manner as in the first embodiment. That is, based on the operating conditions and the surface temperature of the hot rolled steel plate 1 near the delivery side of the roughing mill R, a control device 8 computes the oxide film thickness at the entry side of the rolling mill F3 in a state in which the descaler D1 and the descaler D2 are inactive.

If the computed oxide film thickness less than or equal to the limiting film thickness, operation is continued, without actuating the descaler D1 and the descaler D2. If the computed oxide film thickness is greater than the limiting film thickness, conditions including the actuation of the descaler D1 are incorporated into the aforementioned operating conditions, and the oxide film thickness at the entry side of the rolling mill F3 is computed again.

If the results of the re-computation show the oxide film thickness to be not more than the limiting film thickness, operation is continued, with the descaler D1 being actuated. If the computed oxide film thickness is more than the limiting film thickness, conditions including the actuation of the descaler D1 and the descaler D2 are incorporated into the aforementioned operating conditions, and the oxide film thickness at the entry side of the third stage rolling mill F3 is computed again (i.e., for a third time).

If the results of this third computation show the oxide film thickness to be less than or equal to the limiting film thickness, operation is continued, with the descaler D1 and the descaler D2 being actuated. If the twice re-computed oxide film thickness is greater than the limiting film thickness, a judgment is made that the current operation surpasses a normal operational state. Thus, the working ability of the descaler D1 and the descaler D2 is increased, and the above recomputation is repeated as necessary to restrict the film thickness to the limiting film thickness or less. In this state, the descaler D1 and the descaler D2 are actuated, and operation is performed.

The descaler D1 actuated in this manner jets low pressure water at a jet pressure of, say, 70 kgf/cm$^2$ toward the hot rolled steel plate 1. Hence, even if oxide film on the hot rolled steel plate 1 rolled by the first stage rolling mill F1 grows because of recuperation (temperature recovery), the descaler D1 can decrease the thickness of oxide film on the surface of the hot rolled steel plate 1.

The descaler D2, when actuated, jets low pressure water at a jet pressure of, say, 70 kgf/cm$^2$ toward the hot rolled steel plate 1. Hence, even if oxide film on the hot rolled steel plate 1 rolled by the second stage rolling mill F2 grows because of recuperation (temperature recovery), the descaler D2 can decrease the thickness of oxide film on the surface of the hot rolled steel plate 1.

Figure 7:
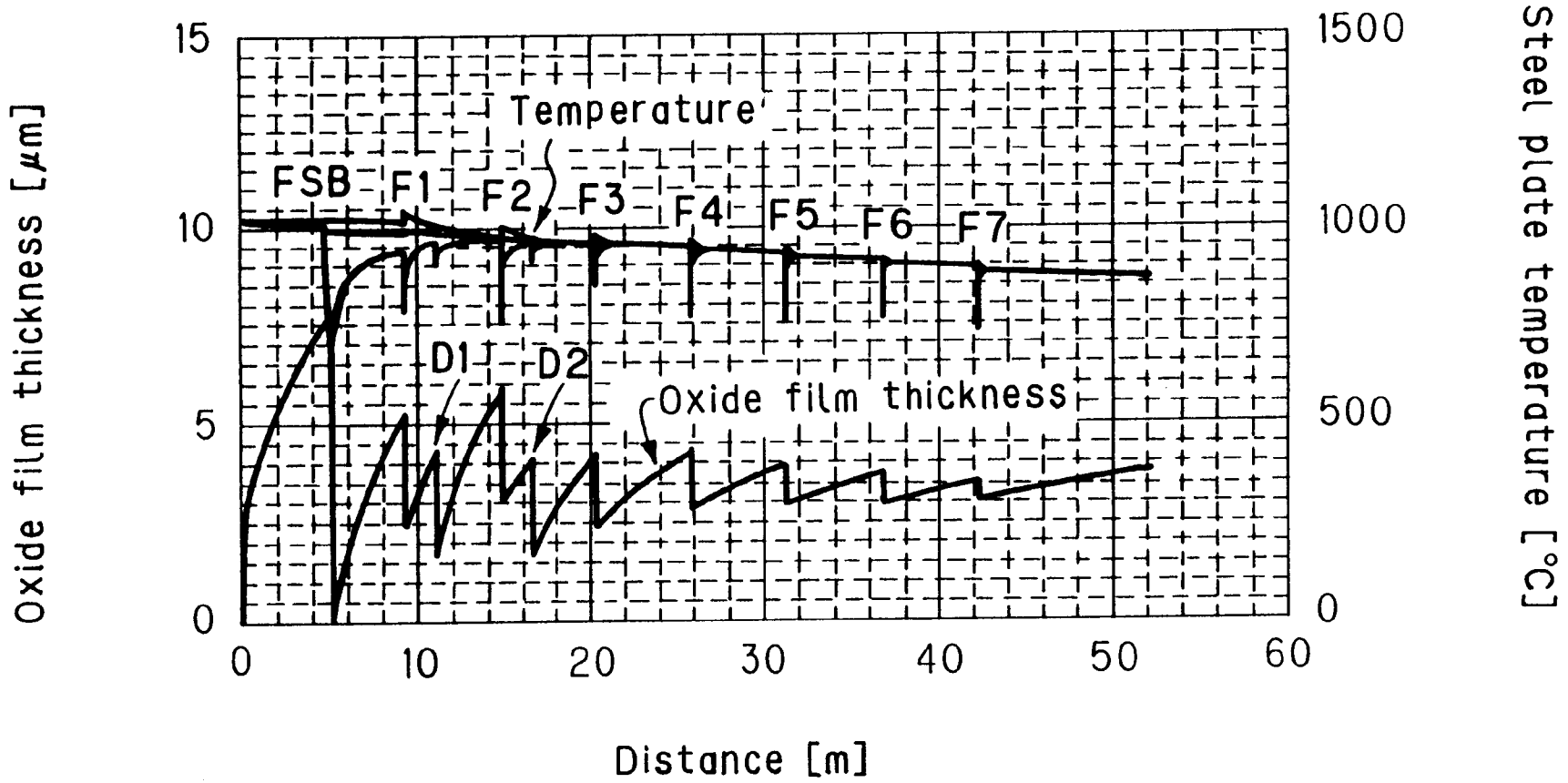
FIG. 7 is a diagram showing a steel plate temperature and an oxide film thickness in the second embodiment.

FIG. 7 is a diagram showing the relation between the steel plate temperature and the oxide film thickness in accordance with the above-described hot rolling method. When the descaler D1 and the descaler D2 of the present invention are actuated, the oxide film thickness at the entry side of the third stage rolling mill F3 is shown to be restricted to about 5 $\mu$m or less. This diagram also shows that oxide film is descaled to about 1.7 $\mu$m by actuation of the descaler D1 and the descaler D2, whereby the oxide film thickness at the entry side of the third stage rolling mill F3 is restricted to about 4.3 $\mu$m, a value less than the limiting oxide film thickness (about 5 $\mu$m). The jet pressure (descaling pressure) of the descaler D1 and the descaler D2 on this occasion may be a low pressure of about 70 kgf/cm$^2$ as in the first embodiment. Thus, economical descaling can be achieved by low pressure jetting.

According to the present embodiment described above, the oxide film thickness at the entry side of the third stage rolling mill F3 can be made smaller than the limiting oxide film thickness (about 5 $\mu$m) by actuating the descaler D1 and the descaler D2 with low pressure jets. Thus, scale defects of the hot rolled steel plate can be dissolved, and rolling of the hot rolled steel plate at a higher rolling temperature than in the first embodiment can be performed without scale defects.

The invention being thus described, it will be obvious that the same may be varied in many ways. Such variations are not to be regarded as a departure from the spirit and scope of the invention, and all such modifications as would be obvious to one skilled in the art, including change of the jet medium for the descaler, are intended to be included within the scope of the following claims.

What is claimed is:

1. A system for preventing scale defects during hot rolling by hot rolling equipment having a scale breaker provided at an entry side of a finishing mill line that has a plurality of rolling mills arranged in tandem, comprising:

a descaler provided between a first stage rolling mill and a second stage rolling mill of the finishing mill line;

a cooler, provided between the second stage rolling mill and a third stage rolling mill of the finishing mill line, for cooling a material to be rolled; and a control device for controlling the descaler and the cooler to be selectively driven based on a computed oxide film thickness of the material at the entry side of the third stage rolling mill, wherein the material is rolled so that the oxide film thickness at the entry side of the third stage rolling mill is maintained less than or equal to a limiting oxide film thickness.

2. The system for preventing scale defects during hot rolling as claimed in claim 1, wherein the limiting oxide film thickness is 5 $\mu$m.

3. The system for preventing scale defects during hot rolling as claimed in claim 1, wherein the descaler jets water at a low pressure of at least about 70 kgf/cm$^2$.

4. The system for preventing scale defects during hot rolling as claimed in claim 1, wherein the control device computes the oxide film thickness of the material based on a temperature of the material at a delivery side of a roughing mill, wherein if the computed oxide film thickness is less than or equal to the limiting oxide film thickness, the control device actuates neither the descaler or cooler;

wherein, if the computed oxide film thickness is greater than the limiting oxide film thickness, the control device incorporates the descaler into operating conditions and re-computes the oxide film thickness, otherwise the control device actuates only the descaler;

wherein, if the oxide film thickness computed after incorporating the descaler into the operating conditions is greater than the limiting oxide film thickness, the control device incorporates both the descaler and cooler into the operating conditions and re-computes again the oxide film thickness, and if the re-computed oxide film thickness is less than or equal to the limiting oxide film thickness, the control device maintains both the descaler and the cooler in operation; and wherein, if the oxide film thickness computed after incorporating both the descaler and the cooler into the operating conditions is still greater than the limiting oxide film thickness, the control device continues actuation of both the descaler and cooler while increasing the ability of both the descaler and the cooler.

5. A system for preventing scale defects during hot rolling of a material by hot rolling equipment having a scale breaker provided at an entry side of a finishing mill line that has a plurality of rolling mills arranged in tandem, comprising:

a descaler provided between a first stage rolling mill and a second stage rolling mill of the finishing mill line;

a descaler provided between the second stage rolling mill and a third stage rolling mill of the finishing mill line; and a control device for controlling the descalers to be selectively driven based on a computed oxide film thickness of a material to be rolled at the entry side of the third stage rolling mill, wherein the material to be rolled is rolled so that the oxide film thickness at the entry side of the third stage rolling mill is maintained less than or equal to a limiting oxide film thickness.

6. The system for preventing scale defects during hot rolling as claimed in claim 5, wherein the limiting oxide film thickness is 5 $\mu$m.

7. The system for preventing scale defects during hot rolling as claimed in claim 5, wherein the descalers jet water at a low pressure of at least about 70 kgf/cm$^2$.

8. The system for preventing scale defects during hot rolling as claimed in claim 5, wherein the control device computes the oxide film thickness of the material based on a temperature of the material at a delivery side of a roughing mill, wherein, if the computed oxide film thickness is less than or equal to the limiting oxide film thickness, the control device actuates neither the descaler at the preceding stage or the descaler at the succeeding stage;

wherein, if the computed oxide film thickness is greater than the limiting oxide film thickness, the control device incorporates the descaler at the preceding stage into operating conditions and re-computes the oxide film thickness, otherwise the control device actuates only the descaler at the preceding stage;

wherein, if the oxide film thickness re-computed after incorporating the descaler at the preceding stage into the operating conditions is greater than the limiting oxide film thickness, the control device incorporates both the descaler at the preceding stage and the descaler at the succeeding stage into the operating conditions and again re-computes the oxide film thickness, otherwise the control device only actuates both the descaler at the preceding stage and the descaler at the succeeding stage; and wherein, if the oxide film thickness re-computed after incorporating descalers at both the preceding and succeeding stages into the operating conditions is greater than the limiting oxide film thickness, the control device continues to operate both descalers at the preceding and succeeding stages, while increasing the ability of the descalers at both stages.

9. A method for preventing scale defects during hot rolling by hot rolling equipment having a scale breaker provided at an entry side of a finishing mill line that has a plurality of rolling mills arranged in tandem, comprising:

providing a descaler between a first stage rolling mill and a second stage rolling mill of the finishing mill line;

providing a cooler between the second stage rolling mill and a third stage rolling mill of the finishing mill line for cooling a material to be rolled; and controlling the descaler and the cooler to be selectively driven, based on a computed oxide film thickness of the material at the entry side of the third stages rolling mill, thereby rolling the material while restricting the oxide film thickness of the material at the entry side of the third stage rolling mill to a thickness less than or equal to a limiting oxide film thickness.

10. A method for preventing scale defects during hot rolling by hot rolling equipment having a scale breaker provided at an entry side of a finishing mill line that has a plurality of rolling mills arranged in tandem, comprising:

providing a descaler between a first stage rolling mill and a second stage rolling mill of the finishing mill line;

providing a descaler between the second stage rolling mill and a third stage rolling mill of the finishing mill line; and controlling the descalers to be selectively driven, based on a computed oxide film thickness of the material at the entry side of the third stage rolling mill, thereby rolling a material to be rolled, while restricting the oxide film thickness of the material at the entry side of the third stage rolling mill to a thickness less than or equal to a limiting oxide film thickness.

11. A system for preventing scale defects in hot rolling equipment having a plurality of tandem rolling mills, comprising:

a descaler interposed between successive stages of rolling mills;

a cooler interposed between successive stages of rolling mills for cooling a material to be rolled; and a control device for controlling the operation of the cooler and descaler by computing an oxide film thickness of the material that is compared with a predetermined limiting oxide film thickness.

12. The system of claim 11, wherein when the computed oxide film thickness of the material is less than or equal to the predetermined limiting oxide film thickness, neither the descaler nor cooler is actuated, otherwise the control device activates only the descaler and re-computes the material's oxide film thickness.

13. The system of claim 12, wherein when the re-computed oxide film thickness of the material is still greater than the predetermined limiting oxide film thickness, the control device actuates the cooler in addition to the already-activated descaler and again re-computes the material's oxide film thickness.

14. The system of claim 13, wherein if the re-computed oxide film thickness of the material after activating the descaler and cooler remains greater than the predetermined limiting oxide film thickness, the control device maintains the descaler and cooler in operation and increases the working ability of both descaler and cooler until the re-computed oxide film thickness is less than or equal to the predetermined limiting oxide film thickness.

15. A system for preventing scale defects in hot rolling equipment having a plurality of tandem rolling mills, comprising:

a first descaler interposed between successive stages of rolling mills;

a second descaler interposed between successive stages of rolling mills; and a control device for controlling the operation of the first and second descalers by computing an oxide film thickness of a material to be rolled that is compared with a predetermined limiting oxide film thickness.

16. The system of claim 15, wherein when the computed oxide film thickness of the material is less than or equal to the predetermined limiting oxide film thickness, neither of the first or second descalers is actuated, otherwise the control device activates only the first descaler and re-computes the material's oxide film thickness.

17. The system of claim 16, wherein if the re-computed oxide film thickness of the material is still greater than the predetermined limiting oxide film thickness, the control device actuates the second desclaer in addition to the already-activated first descaler and again re-computes the material's oxide film thickness.

18. The system of claim 17, wherein if the re-computed oxide film thickness of the material after activating the first and second descalers remains greater than the predetermined limiting oxide film thickness, the control device maintains the first and second descalers in operation and increases the working ability of both descalers until the re-computed oxide film thickness is less than or equal to the predetermined limiting oxide film thickness.

19. A method for preventing scale defects in hot rolling equipment having a plurality of tandem rolling mills, comprising:

providing a descaler between successive stages of rolling mills;

providing a cooler between successive stages of rolling mills for cooling a material to be rolled; and controlling the operation of the cooler and descaler by computing an oxide film thickness of the material that is compared with a predetermined limiting oxide film thickness.

20. The method of claim 19, wherein the descaler and/or cooler is activated based on whether the computed oxide thickness of the material exceeds the predetermined limiting oxide film thickness, the computation of the material oxide film thickness being recomputed as necessary, as well as the descaler and/or cooler activated and controlled until the re-computed material oxide film thickness is less than or equal to the predetermined limiting oxide film thickness.

21. A method for preventing scale defects in hot rolling equipment having a plurality of tandem rolling mills, comprising:

providing a first descaler between successive stages of rolling mills;

providing a second descaler between successive stages of rolling mills; and controlling the operation of the first and second descalers by computing an oxide film thickness of a material to be rolled that is compared with a predetermined limiting oxide film thickness.

22. The method of claim 21, wherein the first descaler and/or second descaler is activated based on whether the computed oxide thickness of the material exceeds the predetermined limiting oxide film thickness, the computation of the material oxide film thickness being recomputed as necessary, as well as the first and/or second descaler being activated and controlled until the recomputed material oxide film thickness is less than or equal to the predetermined limiting oxide film thickness.

* * * * *